US005215453A

United States Patent [19]

Petersen et al.

[11] Patent Number: 5,215,453

[45] Date of Patent: Jun. 1, 1993

[54] GEAR WHEEL ASSEMBLY FOR HYDRAULIC PURPOSES, AND METHOD ASSEMBLING THE SAME

[75] Inventors: Hans C. Petersen, Nordborg; Tom Tychsen, Gråsten, both of Denmark

[73] Assignee: Danfoss A/S, Nordborg, Denmark

[21] Appl. No.: 864,497

[22] Filed: Apr. 7, 1992

[30] Foreign Application Priority Data

Apr. 15, 1991 [DE] Fed. Rep. of Germany ..... 4112291

[51] Int. Cl.[5] ..... F04C 18/00

[52] U.S. Cl. ..... 418/61.3

[58] Field of Search ..... 418/61.3; 24/437

[56] References Cited

U.S. PATENT DOCUMENTS 3,876,343 4/1975 Giversen ..... 418/61.3

4,859,160 8/1989 White, Jr. ..... 418/61.3

*Primary Examiner*—Richard A. Bertsch

*Assistant Examiner*—Charles G. Freay

*Attorney, Agent, or Firm*—Wayne B. Easton

[57] ABSTRACT

A gear wheel assembly of the type having an externally toothed gear wheel and an internally toothed ring wheel with the gear wheel having one less tooth than the ring wheel and the wheels having eccentrically spaced axes with said gear wheel being rotatable about the gear wheel axis which in turn is orbitable about the ring wheel axis. Each tooth of the gear wheel has a flank on each side of the tip thereof with each said flank having a shallow recess formed thereon. Each such recess has three successive curved sections with each such recess starting and ending with the same tangent as the respective adjacent part of the associated flank. With this gear construction an automatic braking action is generated in the absence of hydraulic pressure.

6 Claims, 4 Drawing Sheets

GEAR WHEEL ASSEMBLY FOR HYDRAULIC PURPOSES, AND METHOD ASSEMBLING THE SAME

Figure 1:
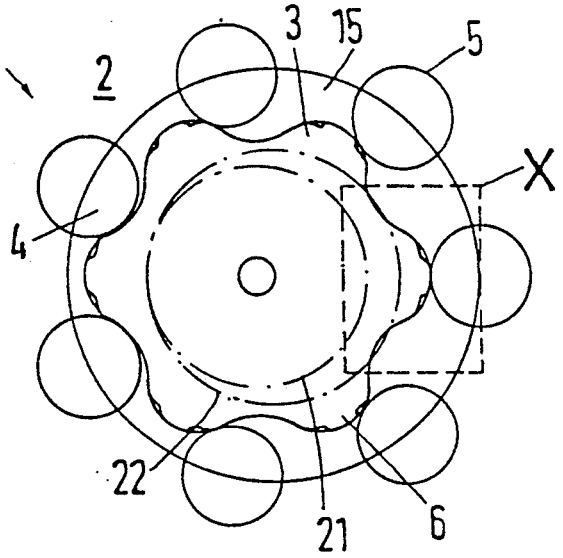

The invention relates to a gear wheel assembly for hydraulic purposes, having a toothed ring with D internal teeth and a gear wheel with n-1 external teeth, the centre point of which is displaced about an eccentricity with respect to the centre point of the toothed ring and rotates about this, the gear wheel rolling on the toothed ring and a recess being provided on the teeth flanks of each tooth. The invention also relates to a method of assembling this gear assembly.

In a known hydraulic rotor U.S. Pat. No. 4,859,160 as the gear wheel orbits in the toothed ring the recesses do not provide a plurality of relatively small chambers for the hydrualic fluid, but just two chambers, that is, two pressure regions. The intention of that feature is that the hydraulic fluid is presented with a relatively low flow resistance. In that case, the recesses have a profile that is bounded substantially by two straight lines. Only at the end of the recess closest to the base of the tooth is an enlargement provided, referred to as a reinforcement, which projects in the direction of the unmodified tooth profile. This is intended to prevent wear and improve the service life and the performance characteristics of the gear wheel assembly.

Gear wheel assemblies of that kind are used, inter alia, as hydraulic motors. It is desirable for these motors to have an extremely low rate of wear and to run with relatively little friction, that is to say, to convert the energy transmitted by the hydraulic fluid into mechanical energy without loss. For that purpose it is customary for the internal teeth to be in the form of rollers that are able to rotate freely in the toothed ring and which are optionally lubricated. More recently, however, there has been an increasing demand for such motors to be self-locking, that is, to be braked when the supply of hydraulic fluid is interrupted. In other words, a force opposing the driving force in the absence of hydraulic pressure shall not be capable of turning the motor backwards. For example, a load lifted by a motor of this kind shall stay in the lifted position even when the supply of hydraulic fluid is interrupted.

The invention is therefore based on the problem of providing a gear wheel assembly which, with normal wear and tear, generates a braking action in the absence of hydraulic pressure.

For a gear wheel assembly of the kind mentioned in the introduction, this problem is solved in that the gear wheel is oversized and each recess has three successive curved sections with alternating direction of curvature and starts and ends with the same tangent as the unmodified tooth shape.

The braking action is essentially achieved in that the gear wheel is oversized. It is therefore so big that under normal circumstances it is unable to orbit in the toothed ring without friction. Even relatively slight enlargements of the normal gear wheel are sufficient for this. In order, however, to enable the gear wheel to orbit in the toothed ring, the recesses are provided. Because of their three successive curved sections of alternating direction of curvature, these recesses are of such a shape that they can be moved past the internal teeth of the toothed ring as the gear wheel orbits in the toothed ring. It is necessary for that purpose, however, for the gear wheel to be pressurized correspondingly by hydraulic fluid. If the pressure is absent, that is to say, the supply of hydraulic fluid is interrupted, there is an equilibrium of pressure between the inlet side and the outlet side of the hydraulic fluid. In that state, friction of the gear wheel in the toothed ring is relatively great, with the result that a braking action is achieved. The braking action need not mean that the gear wheel locks in the toothed ring. With relatively large forces a movement of the gear wheel is quite possible, if the driving forces overcome the braking force. The recesses are merged into the flank of the tooth. Between the tooth and the recess there are no bends or edges. The unmodified shape of the tooth is the shape of the tooth as it would appear without recesses. Because the tangents at the recess and at the tooth profile at both ends of the recess are the same, running behaviour in operation is very gentle and wear-free.

The maximum depth of the recess is preferably only a few hundredths of a millimeter. The correction of the tooth can thus be effected even with quite modest adaptation of the profile of the unmodified tooth shape.

The greatest depth of the recess preferably lies in the region of the vertex of the middle curved section. This need not necessarily mean that the recess is of symmetrical construction.

It is also preferable for the internal teeth to have no contact with the external teeth in the region of the recesses in operation. The seal between the gear wheel and the toothed ring is therefore always effected outside the recesses. The effect of the recesses is that the gear wheel, despite the fact that it is oversized, can be moved without difficulty past the internal teeth of the toothed ring.

The tangent at the deepest point of the recess is preferably parallel with the tangent at the point on the unmodified tooth shape lying opposite the deepest point. The profile of the recess is thus adjusted so that high friction is obtained when the gear wheel is without pressure and is stationary, but so that in principle the friction is not greater than normal when the motor is being operated by the pressure of a hydraulic fluid.

One end of the recess is preferably defined by a point in the region of the tooth tip; when the gear wheel rolls on the toothed ring, this point comes into contact with an internal tooth of the toothed ring at the time at which the next external tooth of the gear wheel comes into contact with the next internal tooth of the toothed ring. In the region of the tooth tip there are therefore two points, namely on each tooth flank, between which there is contact between the external tooth of the gear wheel and the internal tooth of the toothed ring. This portion of the tooth geometry is responsible for sealing the external teeth with respect to the internal teeth of the toothed ring. Because the recess starts directly next to this region, during operation, that is to say, when the gear wheel is being driven by the pressure of the hydraulic fluid, directly next to the sealing region there is therefore immediately sufficient space available when rotation is effected to ensure that contact between the external tooth of the gear wheel and the internal tooth of the toothed ring is avoided.

It is also preferable for the other end of the recess to be defined by a point on the tooth flank, and this point, as the gear wheel rolls on the toothed ring, comes into contact with an internal tooth of the toothed ring at the same time as the other tooth flank comes into contact with the next tooth of the toothed ring. Together with the internal teeth of the toothed ring, the external teeth of the gear wheel form a seal between two pressure zones of different pressure. Since there need only be two pressure zones, not all teeth must provide a seal at the same time. The geometry of the orbital movement, that is to say, the relative movement of the toothed ring and the gear wheel, can be modelled with the help of two circles that roll on one another. The radius of these circles is the eccentricity, that is to say, the distance of the two centre points of the two circles, multiplied by the number of the respective teeth, that is, the n internal teeth of the toothed ring and the n-1 external teeth of the gear wheel. The movement then has a centre of rotation which moves along the two circles when the gear wheel is rotated relative to the toothed ring in the gear assembly. The seal is then always effected at two points, one point being the point at which the gear wheel surface is closest to the centre of rotation and the other point being the point at which the centre of rotation is furthest from the gear wheel surface. Whenever two points are the same distance from the centre of rotation, the seal "jumps" from one tooth to the next. Immediately after the seal has jumped, the internal tooth of the toothed ring lies opposite the recess again, so that in operation there is no appreciable friction here.

According to the invention, a method of assembling the gear wheel assembly is claimed, which is characterized in that the internal teeth are individually mounted, the gear wheel being rotated after the mounting of each internal tooth into another position in order to provide space for the next tooth to be mounted, and the internal teeth are introduced in an axial direction. In this method the gear wheel assembly can thus be assembled without problems even though the gear wheel is oversized, that is, would not actually "fit into" the toothed ring.

Figure 2:
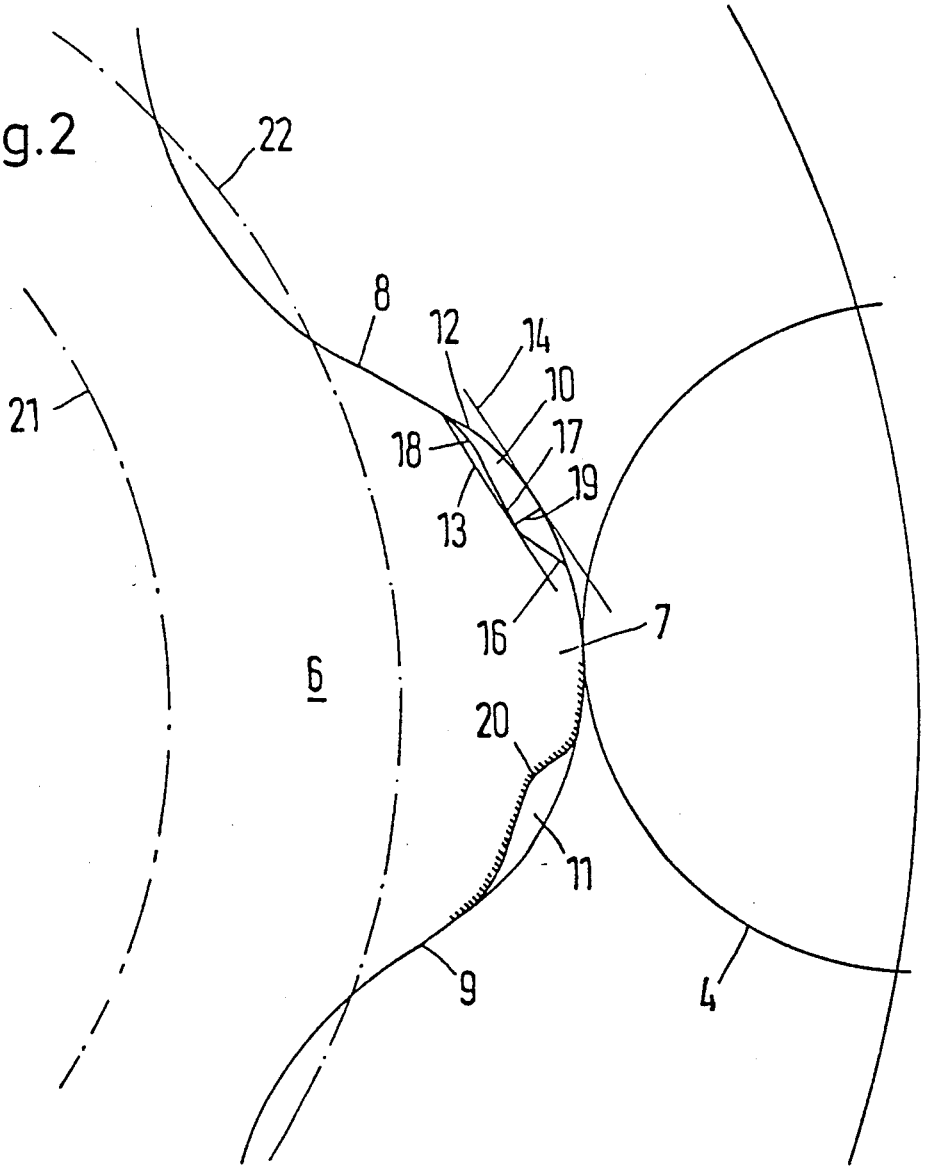

The invention is explained in detail hereinafter with reference to a preferred embodiment, in conjunction with the drawing, in which FIG. 1 is a basic diagram of the gear wheel assembly, FIG. 2 shows an enlarged section II from FIG. 1, FIG. 3(*a–c*) is a sketch for determining the boundaries of the recess, and FIG. 4(*a–e*) is a diagrammatic representation of the gear wheel assembly being assembled.

A gear wheel assembly 1 comprises a toothed ring 2 and a gear wheel 3. The toothed ring 2 has seven internal teeth 4, which in this particular case are in the form of rollers 5 rotatably mounted in a housing 15, illustrated purely diagrammatically, which forms the toothed ring 2. The gear wheel 3 has six external teeth 6. Each external tooth 6 has a tooth tip 7 and two teeth flanks 8, 9. In each tooth flank 8, 9 there is arranged a recess 10, 11. The external tooth 6 has a profile 12 which is interrupted by the recesses 10, 11. Each recess 10, 11 has three successive curved sections 16, 17, 18 with alternating directions of curvature. Starting from the tooth tip 7, the surface of the tooth 6 runs in a curved section 16 initially convexly (viewed from the outside), that is to say, towards the middle of the gear wheel 3, then concavely in a further curved section 17, that is, the curvature is directed towards the outside again, and then in a third curved section 18 convexly again. In the first and the third curved sections 16, 18, the recess 10, 11 merges smoothly into the profile 12 of the tooth, that is, at the two ends, the tooth 6 and the recess 10, 11 have the same tangents. There is thus no break between the tooth profile 12 and the recess 10, 11.

The tangent 13 at the deepest point of the recess is parallel to the tangent at the point on the unmodified tooth shape lying opposite the deepest point. In other words, these two tangents can be joined by a line 19 that is at right angles to both tangents.

The depth of the recess 10, 11 is shown on an exaggeratedly large scale. In reality, the maximum depth of the recess is only a few hundredths of a millimeter.

The recess 10, 11 extends over a region which is illustrated in FIG. 2 by hatching 20. At the two ends of the recess 11 there is virtually no appreciable transition between the recess 11 and the flank 9 and the tooth tip 7.

The exact position of the recess 10, 11 will be explained with reference to FIG. 3.

The relative movement of the gear wheel 3 and the toothed ring 2 can be represented by two circles 21 and 22 which roll on and in one another respectively. The inner circle 21 has a centre point which moves on a centre point circle 23. The radius of the centre point circle 23 corresponds to an eccentricity, that is, to the displacement between the centre points of the movement circle 21 of the gear wheel 3 and the movement circle 22 of the toothed ring 2. The radius of the circle 21 corresponds to the eccentricity multiplied by the number of teeth on the gear wheel 3. The radius of the circle 22 corresponds to the eccentricity multiplied by the number of internal teeth on the toothed ring 2. The point of contact between the two circles 21 and 22 forms a centre of rotation O which travels along the circle 22 as the gear wheel 3 turns in the toothed ring 2.

If the gear wheel assembly is used as a displacing means, for example as a motor, there are at least two pressure zones of different pressures, which have to be sealed from one another by the internal teeth 4 of the toothed ring 2 and the external teeth 6 of the gear wheel 3. In principle, only two pressure zones are required, so that sealing too need be effected only at two points. Sealing is effected at two defined locations, namely at point A, which is the point on the surface of the gear wheel 3 that is closest to point O, and at point B, which is the point on the surface of the gear wheel furthest away from point O.

Figure 3A:
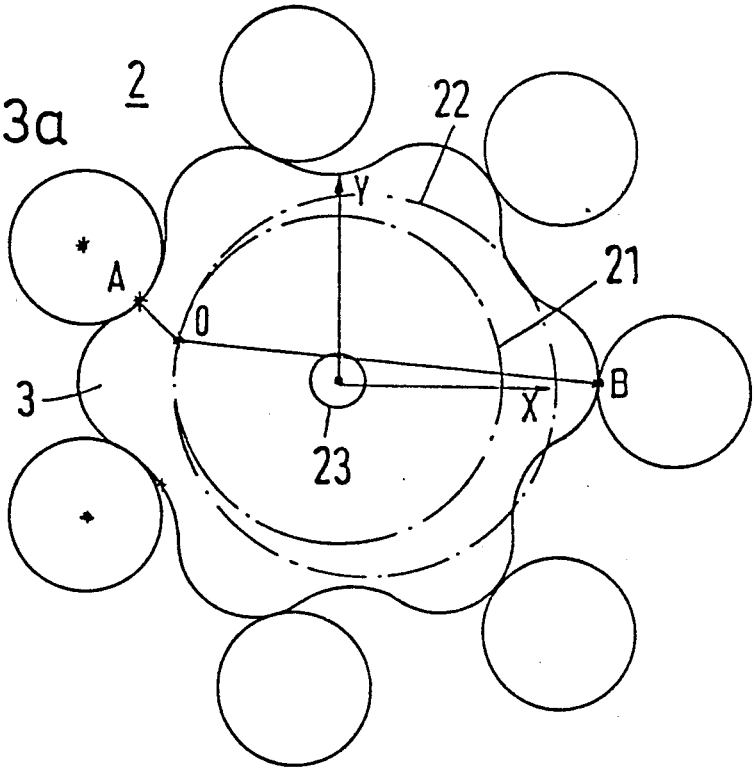
Figure 3B:
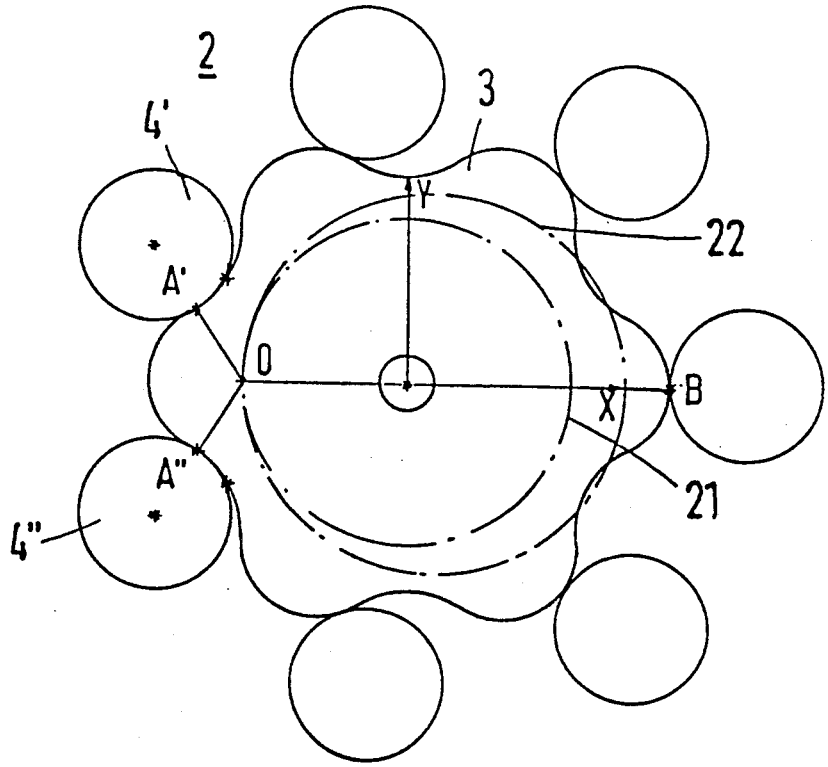
Figure 3C:
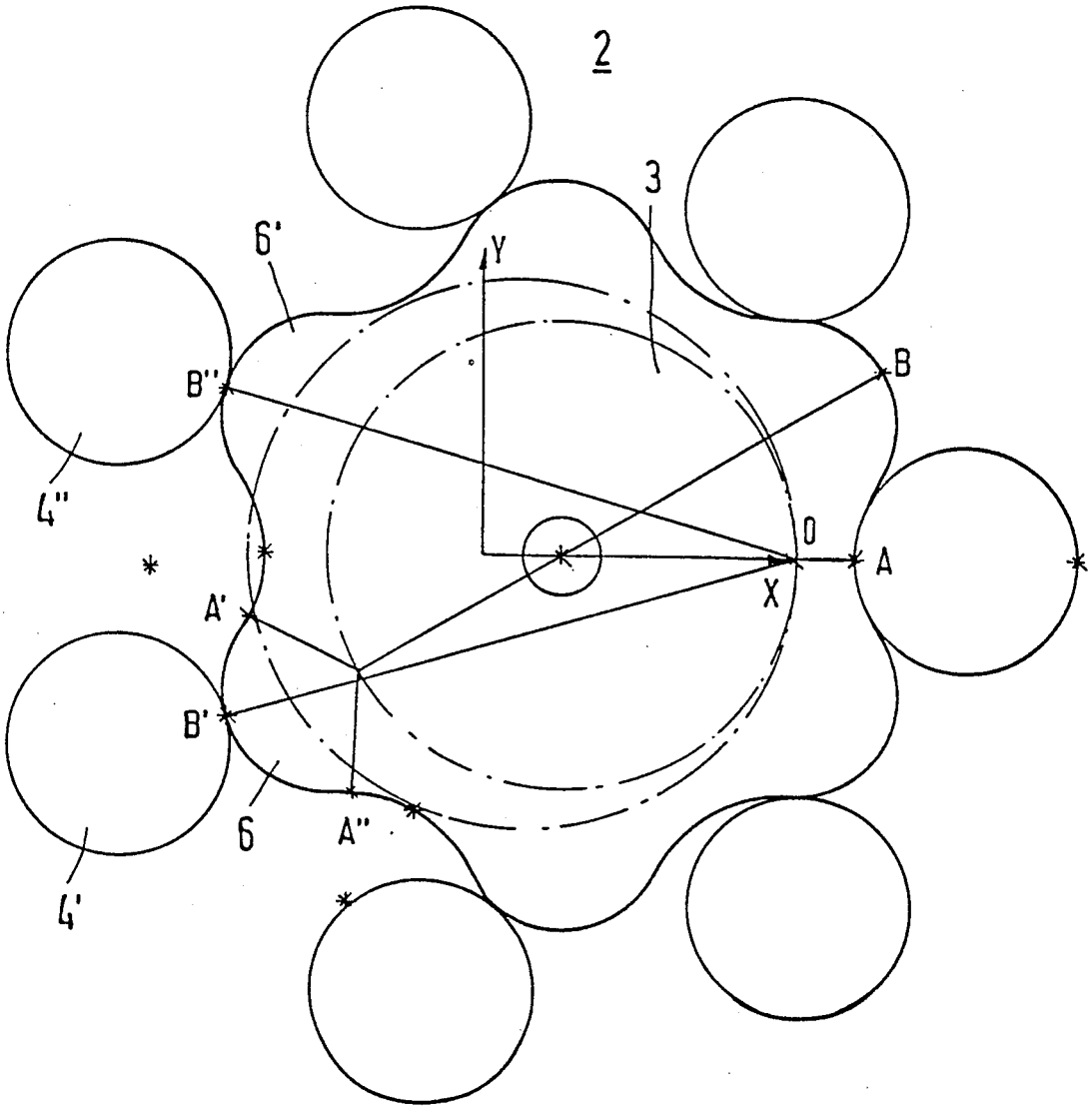

FIG. 3*a* shows an arbitrarily selected position of the gear wheel 3 in relation to the toothed ring 2. In FIG. 3*b*, a position is shown in which two points, namely A' and A'', are the same distance from the centre of rotation zero. At this location the seal jumps from external tooth 4' to the next external tooth 4''. Above the points A' and A'', that is to say, between the two points A', A'' and the tooth tip 7, a seal will never be necessary, that is to say, contact with the internal teeth of the toothed ring 3. The two points A' and A'' thus form on each tooth flank 8, 9 the lower limits for the recess 10, 11. The upper limit is formed by the point of the tooth tip 7 denoted by B in FIG. 3. The construction of the points B, and B'' is effected analogously to the construction of the points A' and A'', that is, B' and B'' are each the same distance from the point O when the seal jumps from external tooth 4, to the next external tooth 4'', as illustrated diagrammatically in FIG. 3*c*. Although the boundary points A' and A'' and also B are illustrated in FIG. 3*b* for opposing teeth, it is obvious that a construction of the boundary points of this kind can be established for all six teeth of the gear wheel 3. FIG. 3*c* shows the start of the construction for further teeth.

The greatest depth of the recess 10, 11 is arranged in the region of the vertex of the middle curved section 17. When the gear wheel 3 orbits in the toothed ring 2, the internal teeth 4 of the toothed ring 2 are able to engage the recess 10, 11 sufficiently deeply so that the internal teeth 4 do not touch the external teeth 6 in the region of the recesses. In this manner it is possible for the gear wheel 3, despite being slightly oversized, to orbit with exactly the same slight friction in the toothed ring 2 as a gear wheel of matched size. The only precondition for this is that there is a higher pressure in one pressure zone than in the other pressure zone; the pressure zones are separated from one another with the help of the seal between the external teeth 6 and the internal teeth 7. If there is a pressure equilibrium between the two pressure zones, at the individual sealing points, for example at the points illustrated in FIG. 2, there is such great friction between gear wheel 3 and toothed ring 2 that the gear wheel assembly is braked with considerable force.

Figure 4:
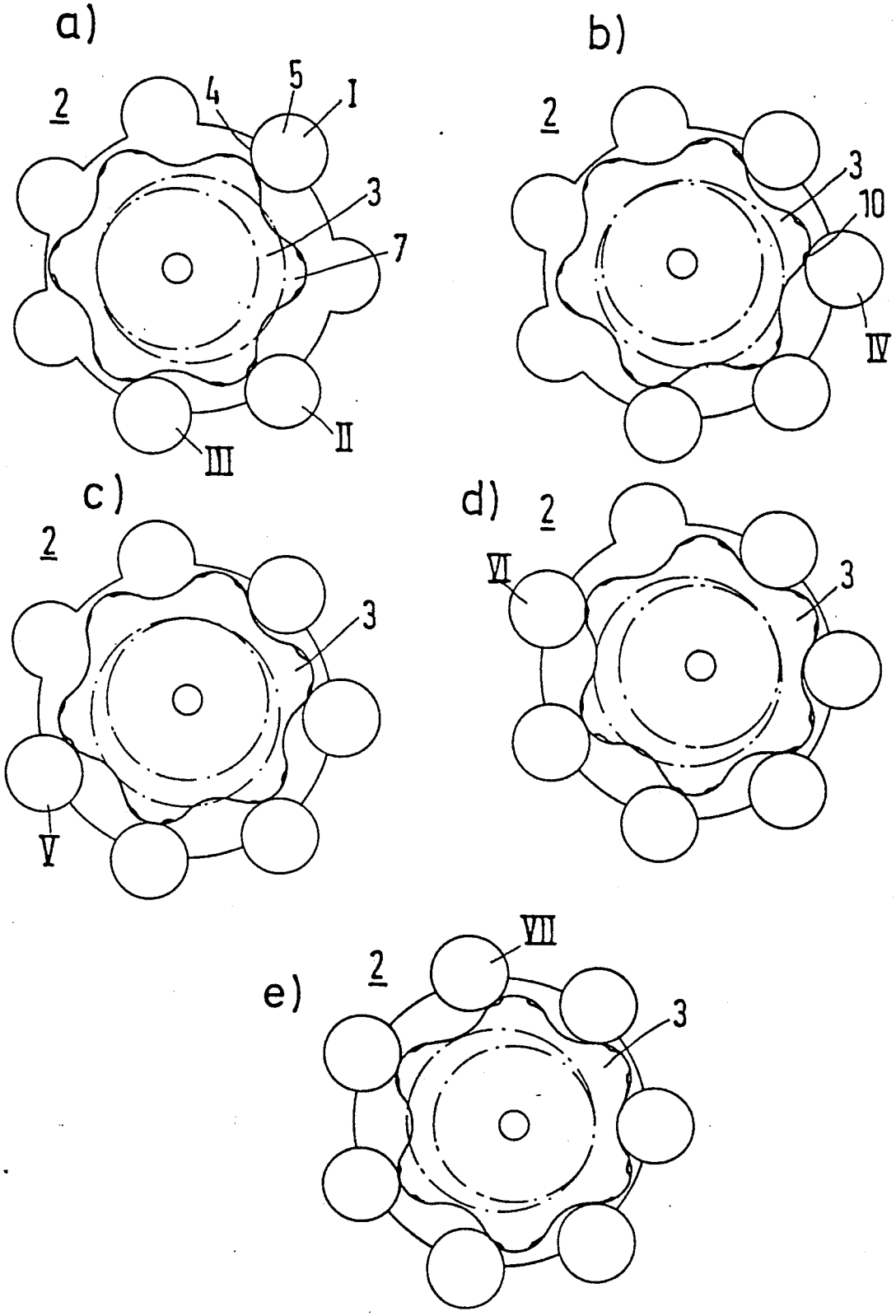

FIG. 4 shows the gear wheel assembly being assembled. The internal teeth 4 are here in the form of rollers 5, that is, cylindrical bodies, which are able to rotate freely in the toothed ring 2. Suitable lubrication of the rollers 5 in the toothed ring 2 means that a very low friction is achieved. Should this friction have no further adverse effects, the rollers 5 can also be replaced by other partially cylindrical bodies which are then arranged stationary in the toothed ring 2.

In FIG. 4*a*, three internal teeth I, II, III have already been mounted in the toothed ring. A fourth internal tooth is now to be mounted in the free position on the far right. However, there is not enough space here because the tooth tip 7 is projecting into the mounting position. In order to be able to install the internal tooth IV, the rotor 3 in FIG. 4*b* has been rotated further through a suitable angle. The position for the internal tooth IV has thereby become free sufficiently for a recess 10 to be present on the rotor 3, so that the internal tooth IV can be introduced. In order to be able to install the internal tooth V of the toothed ring 2, the rotor 3 is again rotated further, so that a corresponding recess on the rotor 3 lies opposite the mounting position for the internal tooth V (FIG. 4*c*). The same applies to the internal teeth VI and VII, which can be inserted after suitable rotation of the rotor (FIG. 4*d*, 4*e*). The installation of the internal teeth is effected in an axial direction, that is, the internal teeth are pushed parallel to the axis of rotation of the gear wheel 3 into the toothed ring 2.

We claim:

1. A gear wheel assembly, comprising, an externally toothed gear wheel and an internally toothed ring wheel with said gear wheel having n teeth and said ring wheel having n+1 teeth, said wheels having eccentrically spaced axes with said gear wheel being rotatable about the gear wheel axis which in turn is orbitable about the ring wheel axis.

each tooth of said gear wheel having a flank on each side of the tip thereof with each said flank having a shallow recess formed thereon, each said recess having three successive curved sections with each said recess starting and ending with the same tangent as the respective adjacent part of the associated flank, and each said recess having a maximum depth on the order of a few hundreths of a millimeter.

2. A gear wheel assembly according to claim 1, characterized in that the greatest depth of each said recess is located in the region of the vertex of the middle curved section.

3. A gear wheel assembly according to claim 1 characterized in that in operation the internal teeth of said gear wheel do not contact the external teeth of said gear wheel in the region of the recesses thereof.

4. A gear wheel assembly according to claim 1 characterized in that the tangent at the deepest point of the recess is parallel with the tangent at the point on the unmodified tooth shape lying opposite the deepest point.

5. A gear wheel assembly according to claim 1 characterized in that it is at the time when the end of the recess in the region of the tooth tip comes into contact with an associated tooth of the ring wheel that the next tooth of the gear wheel comes into contact with the next tooth of the ring wheel.

6. A gear wheel assembly according to claim 1 characterized in that it is at the time when the end of the recess furtherest from the tip comes into contact with an associated tooth of the ring wheel that the next tooth of the gear wheel comes into contact with the next tooth of the ring wheel.

* * * * *